US007687734B2

(12) United States Patent
Weber

(10) Patent No.: US 7,687,734 B2
(45) Date of Patent: Mar. 30, 2010

(54) DOME SWITCH WITH INTEGRAL ACTUATOR

(75) Inventor: Douglas Weber, Arcadia, CA (US)

(73) Assignee: Apple Inc., Cupertino, CA (US)

( * ) Notice: Subject to any disclaimer, the term of this patent is extended or adjusted under 35 U.S.C. 154(b) by 60 days.

(21) Appl. No.: 12/142,333

(22) Filed: Jun. 19, 2008

(65) Prior Publication Data

US 2009/0314619 A1 Dec. 24, 2009

(51) Int. Cl.
*H01H 5/30* (2006.01)

(52) U.S. Cl. ..... 200/406

(58) Field of Classification Search ..... 200/406, 200/516, 533

See application file for complete search history.

(56) References Cited

U.S. PATENT DOCUMENTS

| | | | | |
|---|---|---|---|---|
| 4,739,127 | A * | 4/1988 | Higuchi et al. | 200/5 R |
| 5,660,272 | A * | 8/1997 | Janniere et al. | 200/517 |
| 5,950,808 | A * | 9/1999 | Tanabe et al. | 200/314 |
| 6,392,177 | B1 * | 5/2002 | Zhang et al. | 200/406 |
| 6,815,628 | B2 * | 11/2004 | Okita et al. | 200/406 |
| 7,429,707 | B2 * | 9/2008 | Yanai et al. | 200/1 B |
| 7,449,654 | B2 * | 11/2008 | Tsuduki | 200/406 |
| 2008/0060925 | A1 | 3/2008 | Weber et al. | |
| 2008/0060926 | A1 | 3/2008 | Zadesky et al. | |
| 2008/0062153 | A1 | 3/2008 | Moolsintong et al. | |
| 2009/0000931 | A1 | 1/2009 | Mittleman et al. | |
| 2009/0078553 | A1 | 3/2009 | Sanford et al. | |
| 2009/0122510 | A1 | 5/2009 | Stiehl et al. | |

OTHER PUBLICATIONS

U.S. Appl. No. 12/183,038, entitled "Surface-Mount Dome Switch", filed Jul. 30, 2008.

U.S. Appl. No. 12/113,910, entitled "Button Assembly with Inverted Dome Switch", filed May 1, 2008.

* cited by examiner

*Primary Examiner*—Michael A. Friedhofer

(57) ABSTRACT

A dome switch structure that includes an actuator integrally formed with a dome is disclosed. Advantageously, the actuator can be formed so as to be positioned over and properly aligned with the dome. In one embodiment, the dome switch structure is used by an electronic device to provide user input. When the actuator is pressed by a user, the actuator depresses the dome and induces a switching action. In one embodiment, the dome switch structures can be manufactured (i.e., machined) as a unitary structure. Consequently, since actuators and domes can be formed together, the dome switch structures yield not only consistent accurate alignment but also simplified assembly of dome switches. Given the accurate alignment of an actuator to a corresponding dome, dome switches formed from the dome switch structures can have consistent and reliable tactile feel to users, which thereby provides reliable usage by users.

22 Claims, 4 Drawing Sheets

DOME SWITCH WITH INTEGRAL ACTUATOR

BACKGROUND OF THE INVENTION

1. Field of the Invention

The present invention relates to dome switches suitable for use in electronic devices.

2. Description of the Related Art

Dome switches are well-known and often used in consumer electronic products to implement buttons. For example, various consumer electronic devices, e.g., a mobile telephone, a personal digital assistant, game controller, or remote controller, typically include a plurality of buttons that a user can press to invoke various operations with respect to such devices. Such buttons can, for example, be used for function (e.g., send, end, navigate, etc.) buttons or for buttons of an alphanumeric keypad/keyboard. These buttons in many cases are implemented by dome switches.

A dome switch consists of a dome made from metal or plastic that can be deformed temporarily by a user press to invoke a switching action. Then, when the user press is removed, the dome returns to its original, undeformed shape. Today, with many electronic devices, proper operation of buttons is an important requirement for usability and user satisfaction. With respect to dome switches, the tactile feedback provided by dome switches is often very helpful to users of the consumer electronic products. However, conventional assembly of such buttons implemented by dome switches is inefficient and complicated. Generally, a dome must be placed on a substrate and corresponding structures often provide a button or key structure (with or without an actuation nub) that can be pressed downward to engage the dome during a button or key press. In some designs, activation nubs are provided on the button or key structure or on the peaks of the domes themselves. In any case, the formation of the activation nubs is a separate manufacturing step that is tedious and time-consuming. In addition, the placement of the actuation nubs relative to the domes is not always as accurate as desired. For example, if the actuation nub does not properly align with the center region of a dome, the tactile feedback for such dome switch will be disturbed and therefore not as robust as intended.

SUMMARY OF THE INVENTION

The invention pertains to a dome switch structure that includes an actuator integrally formed with a dome. Advantageously, the actuator can be formed so as to be positioned over and properly aligned with the dome. In one embodiment, the dome switch structure is used by an electronic device to provide user input. When the actuator is pressed by a user, the actuator depresses the dome and induces a switching action. In one embodiment, the dome switch structures can be manufactured (i.e., machined) as a unitary structure. Consequently, since actuators and domes can be formed together, the dome switch structures yield not only consistent accurate alignment but also simplified assembly of dome switches. Given the accurate alignment of an actuator to a corresponding dome, dome switches formed from the dome switch structures can have consistent and reliable tactile feel to users, which thereby provides reliable usage by users.

The invention may be implemented in numerous ways, including, but not limited to, as a system, device, apparatus, or method. Several exemplary embodiments of the present invention are discussed below.

As a dome-actuator structure for use in a dome switch, one embodiment of the invention can, for example, include at least: a dome, and an actuator feature attached to and positioned over the dome such that depressing of the actuator operates to depress the dome.

As an electronic device, one embodiment of the invention can, for example, include at least: a substrate having electrical contacts; and at least one switching apparatus including at least a dome and an actuator, the dome being provided on or proximate to the substrate, and the actuator being aligned over and integral with the dome.

As a method for forming a dome switch, one embodiment of the invention can, for example, include at least: obtaining a metal sheet; forming a dome-actuator structure in the metal sheet; separating the dome-actuator structure from the metal sheet; and manipulating the dome-actuator structure such that the actuator feature is positioned over the dome.

As a method for forming a dome switch, another embodiment of the invention can, for example, include at least: obtaining a metal sheet; forming a dome at a first region of the metal sheet; forming an actuator feature at a second region of the metal sheet; separating the dome and the actuator feature from the metal sheet; and positioning the actuator feature over the dome.

As a method for operating a dome switch, one embodiment of the invention can, for example, include at least: receiving a user press of a user input assembly including a dome and an actuator feature; and depressing the dome via the actuator feature in response to the user press so as to make an electrical connection to induce a switching action.

Various aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, in which.

DETAILED DESCRIPTION OF THE INVENTION

Exemplary embodiments of the present invention are discussed below with reference to the various figures. However, those skilled in the art will readily appreciate that the detailed description given herein with respect to these figures is for explanatory purposes, as the invention extends beyond these embodiments.

The invention pertains to a dome switch structure that includes an actuator integrally formed with a dome. Advantageously, the actuator can be formed so as to be positioned over and properly aligned with the dome. In one embodiment, the dome switch structure is used by an electronic device to provide user input. When the actuator is pressed by a user, the actuator depresses the dome and induces a switching action. In one embodiment, the dome switch structures can be manufactured (i.e., machined) as a unitary structure. Consequently, since actuators and domes can be formed together, the dome switch structures yield not only consistent accurate alignment but also simplified assembly of dome switches. Given the accurate alignment of an actuator to a corresponding dome, dome switches formed from the dome switch structures can have consistent and reliable tactile feel to users, which thereby provides reliable usage by users.

In one embodiment, the dome switch structure is used by an electronic device to provide user input. When the actuator is pressed by a user, the actuator depresses the dome and induces a switching action. In addition, given the pressure to make electronic devices smaller and thinner, there is a need to make components smaller and thinner. With respect to dome switches, the ability to integrate the actuator with the dome serves to reduce the overall height of the dome and actuator combination.

The invention can be utilized in a variety of different devices (e.g., electronic devices) including, but not limited to including, portable and highly compact electronic devices (i.e., portable electronic devices) with limited dimensions and space. In one embodiment, a device may be a laptop computer, a tablet computer, a media player, a mobile phone (e.g., cellular phone), a personal digital assistant (PDA), other handheld electronic devices, a computer mouse, a keyboard, a remote control, a computer accessory, and/or a computer peripheral. Typically, the electronic devices include at least one electrical component inside its housing. The electrical component can, for example, be an integrated circuit or circuit board. Examples of integrated circuits include memory, processor (microprocessor or controller), ASIC, and various others.

Figure 1A:
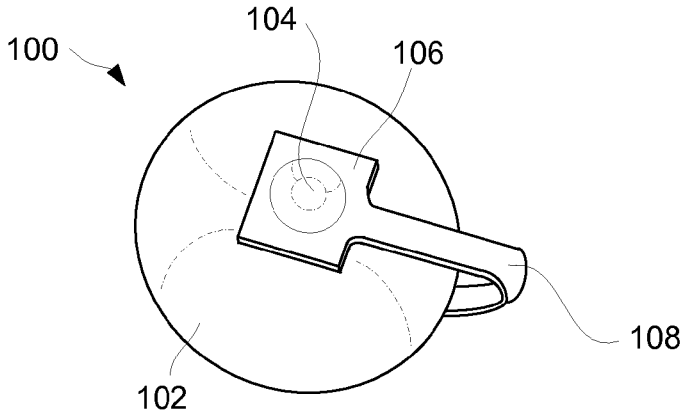
FIG. 1A is a perspective view representation of a dome-actuator structure according to one embodiment of the invention.

FIG. 1A is a perspective view representation of a dome-actuator structure 100 according to one embodiment of the invention. In the dome-actuator structure 100 includes a dome 102. The dome 102 is designed to be deformable material. In one implementation, the dome 102 can be a thin shell of stainless steel. The dome-actuator structure 100 also includes an actuator 104 that is stably positioned above the dome 102. The actuator 104 can be formed in a platform 106 (or paddle) which is stably positioned above the dome 102 by an arm 108. The arm 108 couples the actuator 104 to the dome 102. In one implementation, the dome 102, the actuator 104, the platform 106 and the arm 108 are all integrally formed from a common piece of material, such as stainless steel.

Figure 1B:
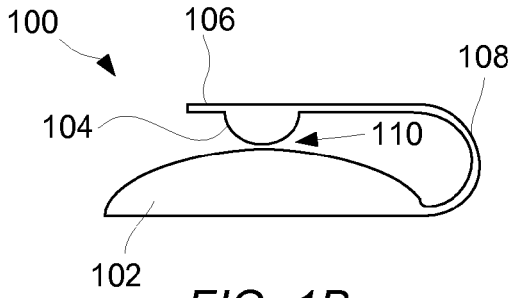
FIG. 1B is a side-view representation of the dome-actuator structure according to one embodiment of the invention.

FIG. 1B is a side-view representation of the dome-actuator structure 100 according to one embodiment of the invention. As shown in FIG. 1B, the curved surface of the dome 102 points upward, while the curved surface of the actuator 104 points downward. Although the actuator 104 is shown as also have a dome shape, in other embodiments the actuator 104 can have other shapes, configurations or profiles. At an interface region 110, the lower portion of the actuator 104 can contact, or nearly contact, the upper portion of the dome 102. Typically, the dome-actuator structure 100 can be utilized in a dome switch which is operated by a user pressing upon the dome switch. The dome-actuator structure 100 illustrated in FIG. 1B corresponds to the situation in which a user is not pressing upon the dome switch utilizing in the dome-actuator structure 100. The dome-actuator structure 100 is suitable for thin or low-profile switch designs. In one embodiment, the height of the dome-actuator structure 100 above the dome can be minimal, for example, on the order of 0.20 millimeters.

Figure 1C:
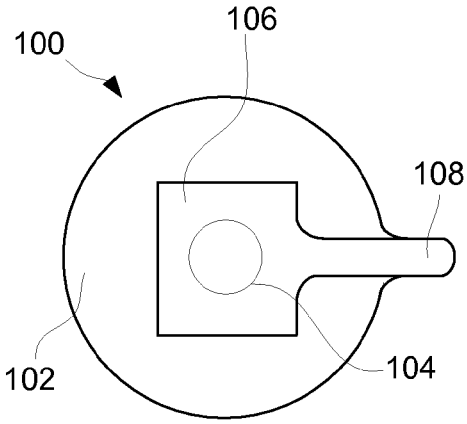
FIG. 1C is a top-view representation of the dome-actuator structure according to one embodiment of the invention.

FIG. 1C is a top-view representation of the dome-actuator structure 100 according to one embodiment of the invention. As shown in FIG. 1C, the actuator 104 is accurately positioned over the center of the dome 102. The positioning of the actuator 104 is indicted and stabilized by the platform 106 and the arm 108. As shown in FIG. 1C, the arm 108 is relatively thin so that it can be easily bent into the appropriate configuration for the dome-actuator switch 100. Also, since the platform 106 is relatively thin, the platform 106 does not disturb the tactile responsiveness of the dome 102 to user presses of a dome switch that utilizes the dome-actuator structure 100.

The size of the dome-actuator switch 100 can vary with implementation. In one embodiment, the dome 102 can have a diameter of about 3-8 mm, the actuator 104 can have a diameter of about 0.75-1.5 mm, the width of the platform 106 can be about 1.7-6 mm, and a width of the arm 108 can be about 0.5-2 mm. In one particular embodiment, the dome 102 can have a diameter of about 4.5 mm, the actuator 104 can have a diameter of about 1.0 mm, the width of the platform 106 can be about 2.0 mm, and a width of the arm 108 can be about 0.5 mm.

Figure 2A:
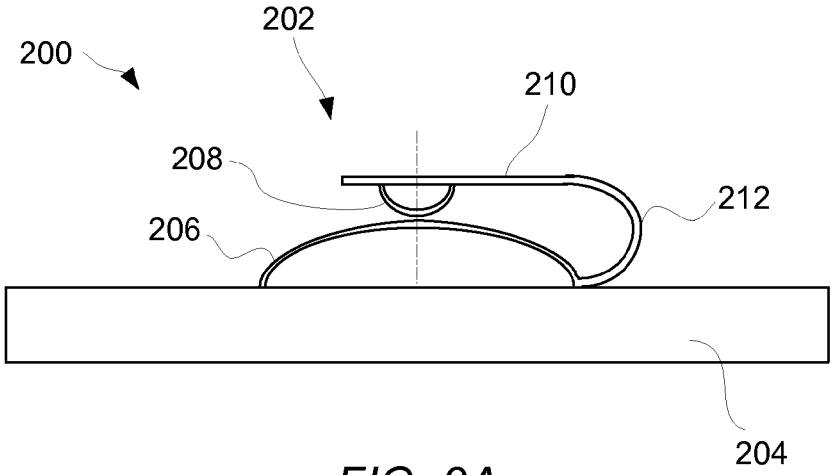
FIG. 2A is a cross-sectional side view representation of a dome switch assembly in an uncompressed state according to one embodiment of the invention.

FIG. 2A is a cross-sectional side view representation of a dome switch assembly 200 in an uncompressed state according to one embodiment of the invention. The dome switch assembly 200 includes a dome-actuator structure 202. The dome-actuator structure 202 is placed and adhered to a substrate 204. The substrate 204 typically provides electrical interconnects (not shown) such as metal traces on at least one surface of the substrate 204. In one implementation, the substrate 204 can pertain to a Printed Circuit Board (PCB). In another implementation, the substrate 204 can pertain to a flexible substrate, such as a flex-circuit. The dome-actuator structure 202 can be adhered to the substrate 204 by any of a number of different ways. As one example, an adhesive (e.g., adhesive tape) can be utilized to adhere to the dome-actuator structure 202 to the surface of the substrate 204. As another example, the dome-actuator structure 202 can be soldered to the surface of the substrate 204.

The dome-actuator structure 202 includes a dome 206 having an open end adjacent to the surface of the substrate 204, and a closed end having a curved surface that extends upward away from the surface of the substrate 204. The thickness of the dome 206 is typically in a range of 0.05-0.1 millimeters. For example, the dome-actuator structure 202 can be stainless steel (e.g., SUS 301), and the thickness of the dome 206 is typically in a range of 0.07 millimeters. The dome-actuator structure 202 also includes an actuator 208. The actuator 208 can also have a dome-like configuration. The actuator 208 can have an open end that is adjacent to a surface of a platform 210. In one implementation, the actuator 208 is formed from a portion of the platform 210. The closed end of the actuator 208 has a curved surface that extends downward towards the dome 206. As illustrated in FIG. 2A, the actuator 208 is positioned such that the center of the closed end of the actuator 208 is substantially aligned with the center of the closed end of the dome 206. The platform 210 is held in position by an arm 212 which is also part of the dome-actuator structure 202. In the uncompressed state as illustrated in FIG. 2A, the actuator 208 can be directly adjacent to the dome 206. In this uncompressed state, the actuator 208 may slightly biased against the dome 206 or there might be a slight gap (e.g., opening) between the actuator 208 and the dome 206.

Figure 2B:
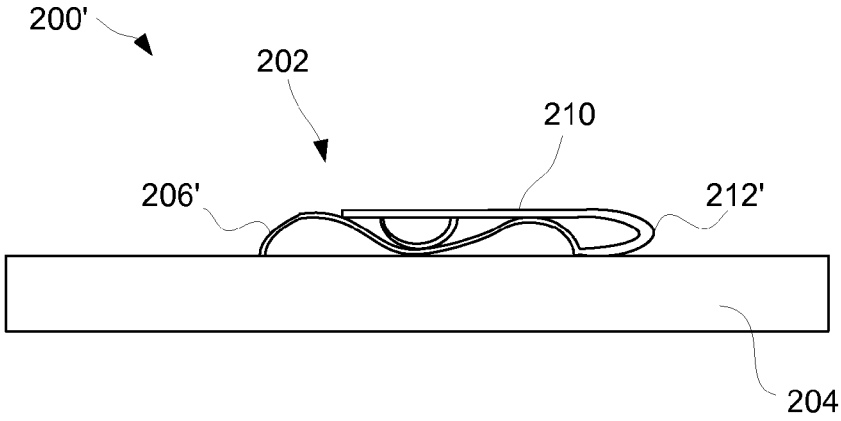
FIG. 2B is a cross-sectional side view representation of a dome switch assembly in a compressed state according to one embodiment of the invention.

FIG. 2B is a cross-sectional side view representation of a dome switch assembly 200' in a compressed state according to one embodiment of the invention. The dome switch assembly 200' represents the dome switch assembly 200 shown in FIG. 2A after being compressed. In the compressed state, the dome switch assembly 200' is fully compressed, such as due to a user press on the platform 210. Typically, there is an intermediate structure (e.g., button cover) between the platform 210 and a user's finger, but nonetheless, the user press is translated to compress the dome-actuator structure 202. As shown in FIG. 2B, upon compression, the platform 210 is forced downward toward the surface of the substrate 204. As a result, the actuator 208 is forced into the dome 206. As the actuator 208 is pushed downward into the dome 206', the dome 206' deforms as illustrated in FIG. 2B. Advantageously, when the platform 210 is compressed downward, the platform 210 ensures that the actuator 208 is pushed downward normal to a target region (e.g., target press region 410) on the actuator 208. In addition, the arm 212' is able to deform when the dome-actuator structure 202 is compressed. When the platform 210 is fully compressed downward such as illustrated in FIG. 2B, the deformed dome 206' clauses electrical contact with respect to electrical traces (not shown) on the surface of the substrate 204, thereby inducing a switching action.

It should be noted that the compressed state typically requires a downward force to be exerted on the platform 210. Typically, the downward force is induced by a user press action. Once the downward force is removed, the platform 210 by way of the arm 212' recovers to its uncompressed state and the dome 206' returns to its uncompressed state, such as illustrated in FIG. 2A.

Figure 2C:
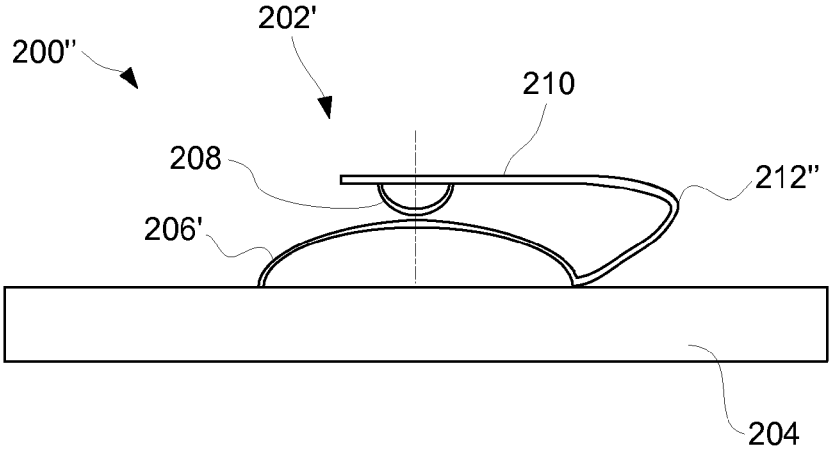
FIG. 2C is a cross-sectional side view representation of a dome switch assembly in an uncompressed state according to another embodiment of the invention.

FIG. 2C is a cross-sectional side view representation of a dome switch assembly 200" in an uncompressed state according to one embodiment of the invention. The dome switch assembly 200" includes a dome-actuator structure 202'. The dome switch assembly 200" is generally similar to the dome switch assembly 200 illustrated in FIG. 2A except that the dome-actuator structure 202' has an arm 212' that include a bend so that compression of the platform 210 by way of the arm 212" is able to more easily flex when the when the dome-actuator structure 202' is compressed.

Figure 3:
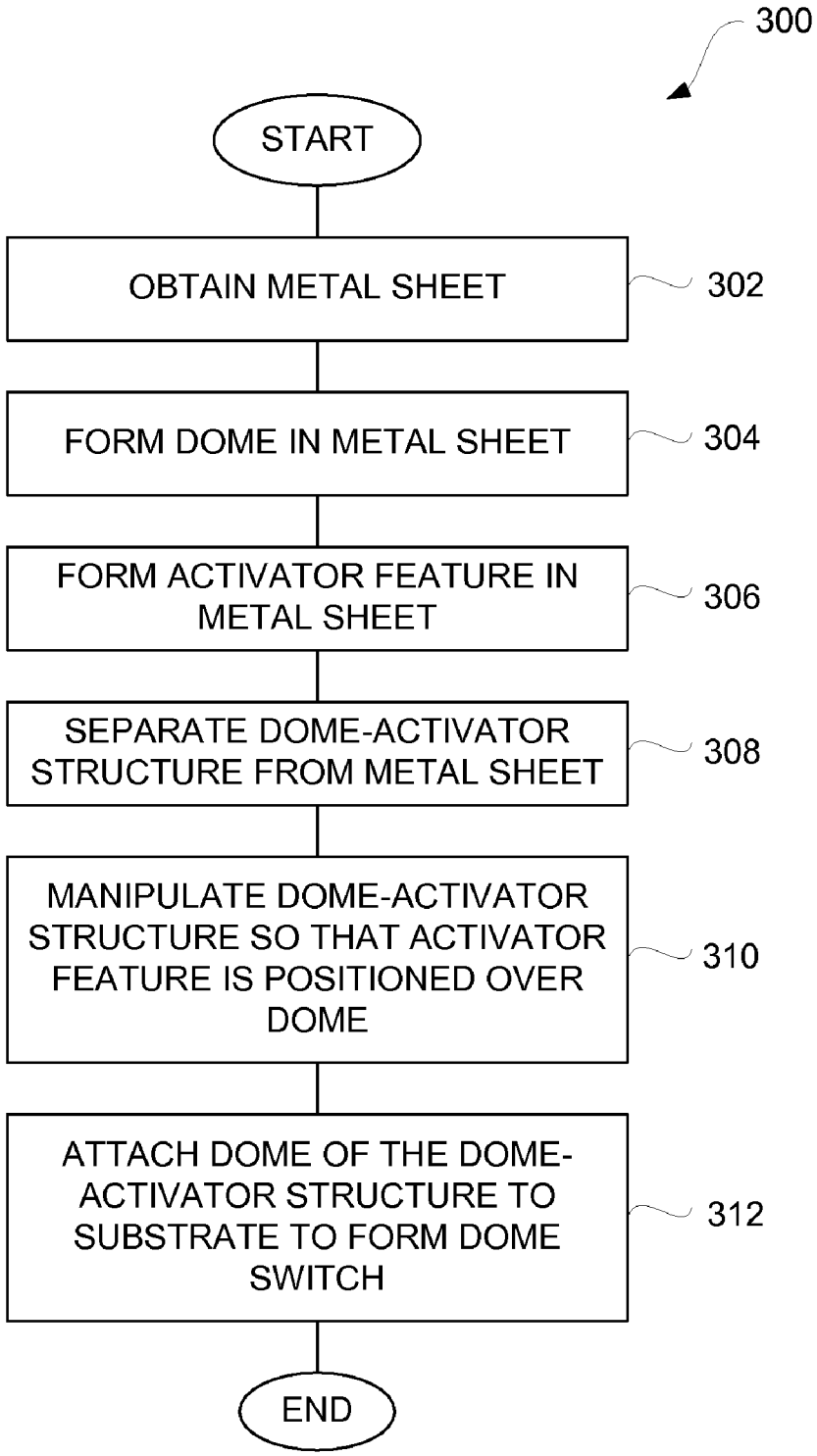
FIG. 3 is a flow diagram of a dome switch manufacturing process according to one embodiment of the invention.

FIG. 3 is a flow diagram of a dome switch manufacturing process 300 according to one embodiment of the invention. The dome switch manufacturing process 300 can, for example, concern the manufacture of a dome-actuator structure that is utilized in forming a dome switch.

The dome switch manufacturing process 300 can initially obtain 302 a metal sheet. For example, the metal sheet can be a sheet of stainless steel (e.g., stainless steel 301) with a thickness of about 0.07 millimeters. Next, a dome can be formed 304 in the metal sheet. The formation of the dome into the metal sheet can be done by a progressive die approach in which the dome is gradually formed into the metal sheet in several stages. In addition, an actuator feature can be formed 306 in the metal sheet. The actuator can also be formed utilizing a progressive die approach. In one implementation, the dome and the actuator feature can be concurrently formed. In another implementation, the dome and the actuator feature can be formed sequentially.

After the dome and the actuator feature have been formed 304 and 306, a dome-actuator structure can be separated 308 from the metal sheet. The separation 308 can be performed by a stamping action or a cutting action. For example, the dome-actuator structure can be stamped out of the metal sheet as a unitary structure. As another example, the dome-actuator structure can be cut or diced from the metal sheet using any in a number of conventional approaches. After the dome-actuator structure has been separated 308 from the metal sheet, the dome-actuator structure can be manipulated 310 so that the actuator feature is positioned over the dome. As an example, the dome-actuator structure can include a flexure (e.g., arm) that couples together in the actuator and the dome. The flexure serves to position the actuator relative to the dome. At this point, the dome-actuator structure has been formed by the dome switch manufacturing process 300. Thereafter, the dome of the dome-actuator structure can be attached 312 to a substrate so as to form a dome switch. Typically, operations 302-310 are repeatedly performed using to form a plurality of dome-actuator structures. The various dome-actuator structures can be formed one at a time or more than one at a time.

FIGS. 4A-4D are top-view diagrams illustrating formation of a dome-actuator structure according to one embodiment of the invention. The formation of the dome-actuator structure can be achieved in accordance with the dome switch manufacturing process 300 illustrated in FIG. 3.

Figure 4A:
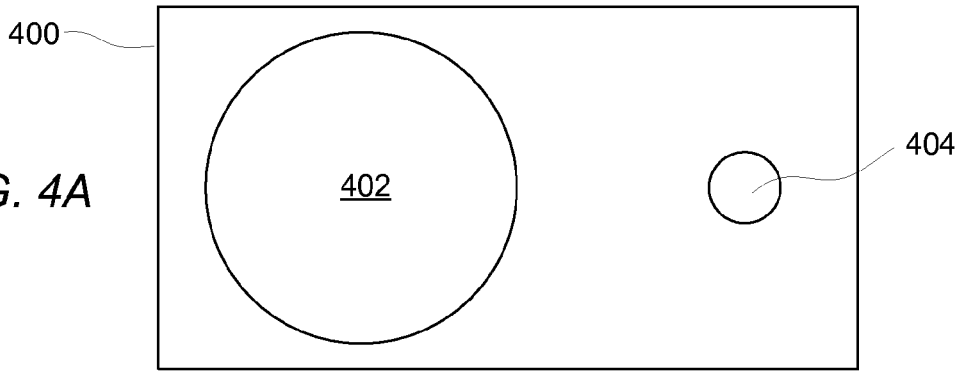
FIGS. 4A-4D are top-view diagrams illustrating formation of a dome-actuator structure according to one embodiment of the invention.
Figure 4B:
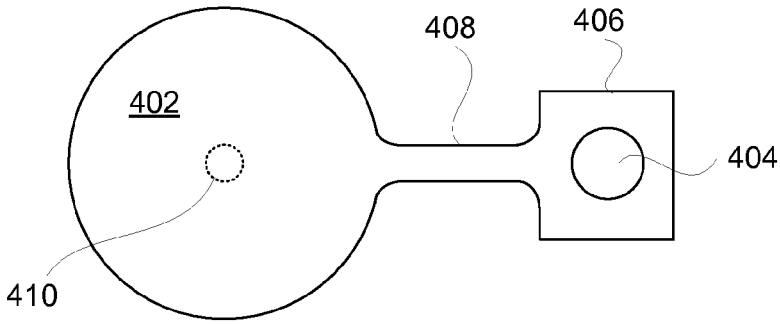
Figure 4C:
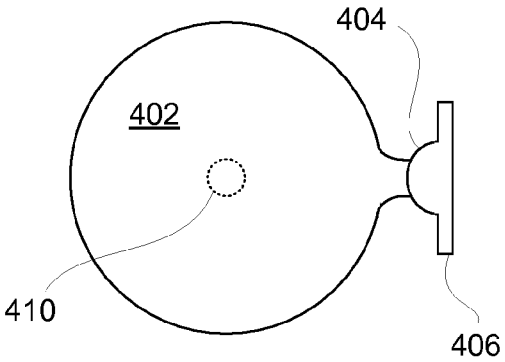
Figure 4D:
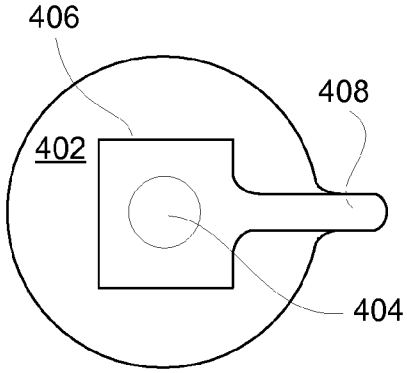

In FIG. 4A, a metal sheet 400 is provided, and a dome 402 and an actuator feature 404 are formed 304 and 306 into the metal sheet 400. FIG. 4B illustrates a dome-actuator structure after being separated 308 from the metal sheet 400. Here, the dome-actuator structure is able to be punched or cut from the metal sheet 400. As shown in FIG. 4B, the resulting dome-actuator structure includes the dome 402 and the actuator feature 404 as well as a platform 406 and a flexure 408. For reference, the dome 402 can also be considered to have a target press region 410, which represents a location on the dome 402 that is a desired point of contact. FIG. 4C illustrates a dome-actuator structure midway through the manipulation 310. As shown in FIG. 4C, the platform 406 has been rotated approximately ninety degrees (90°) by way of bending the flexure 408 of the dome-actuator structure. FIG. 4D illustrates the dome-actuator structure in its final state. As shown in FIG. 4D, the flexure 408 has been rotated a total of one-hundred and eighty degrees (180°) by way of bending the flexure 408 another approximately ninety degrees (90°) (from the position shown in FIG. 4C) so that the platform 406 is provided over the dome 402. Consequently, the actuator 404 can be positioned over and aligned with the target press region 410 of the dome 402.

In the foregoing description, reference to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention.

The advantages of the invention are numerous. Different aspects, embodiments or implementations may, but need not, yield one or more of the following advantages. One advantage of certain embodiment of the invention is that dome structures can have accurately aligned actuator. Another advantage of the invention is that assembly of dome switches is simplified since actuators can be integrally formed with domes. Yet another advantage of the invention is that compact dome switches for low profile electronic devices are facilitated.

The many features and advantages of the present invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A dome-actuator structure for use in a dome switch, said dome-actuator structure comprising:

a dome; and an actuator feature attached to and positioned over said dome such that depressing of said actuator operates to depress said dome, wherein said dome-actuator structure has a one-piece construction.

2. A dome-actuator structure as recited in claim 1, wherein said actuator feature is aligned with said dome.

3. A dome-actuator structure as recited in claim 1, wherein said actuator feature comprises a nub directed towards and aligned with a center region of said dome.

4. A dome-actuator structure for use in a dome switch, said dome-actuator structure comprising:

a dome; and an actuator feature attached to and positioned over said dome such that depressing of said actuator operates to depress said dome, wherein said dome and said actuator are metal, and wherein said dome and said actuator are integrally formed from a metal sheet.

5. An electronic device, comprising:

a substrate having electrical contacts; and at least one switching apparatus including at least a dome and an actuator, the dome being provided on or proximate to said substrate, and the actuator being aligned over and integral with the dome.

6. An electronic device as recited in claim 5, wherein said substrate is a printed circuit board.

7. An electronic device as recited in claim 5, the dome and the actuator are formed from a contiguous sheet of metal.

8. An electronic device as recited in claim 5, wherein a center region of the dome is a target zone, and wherein the actuator is aligned over the target zone of the dome.

9. An electronic device as recited in claim 8, wherein the actuator comprises an actuation nub for alignment with the target zone.

10. An electronic device as recited in claim 5, wherein an arm connects the actuator to the dome.

11. An electronic device as recited in claim 10, wherein the arm is bent to align and position the actuator over the dome.

12. A method for forming a dome switch, said method comprising:

obtaining a metal sheet;

forming a dome-actuator structure in the metal sheet;

separating the dome-actuator structure from the metal sheet; and manipulating the dome-actuator structure such that the actuator feature is positioned over the dome.

13. A method as recited in claim 12, wherein following said manipulating the actuator feature is centered above the dome.

14. A method as recited in claim 12, wherein said method is performed in a multi-stage manufacturing tool.

15. A method as recited in claim 12, wherein said manipulating comprises bending a portion of the dome-actuator structure such that the actuator feature is positioned over the dome.

16. A method as recited in claim 12, wherein the dome-actuator structure has an arm that integrally connects the actuator feature to the dome.

17. A method as recited in claim 16, wherein said manipulating comprises bending the arm of the dome-actuator structure such that the actuator feature is positioned over the dome.

18. A method as recited in claim 12, wherein the metal sheet is stainless steel.

19. A method as recited in claim 12, wherein said method further comprises:

attaching the dome-actuator structure to a substrate having electrical contacts, thereby forming a dome switch.

20. A method for forming a dome switch, said method comprising:

obtaining a metal sheet;

forming a dome at a first region of the metal sheet;

forming an actuator feature at a second region of the metal sheet;

separating the dome and the actuator feature from the metal sheet; and positioning the actuator feature over the dome.

21. A method as recited in claim 20, wherein said method further comprises:

attaching the dome to a substrate having electrical contacts, thereby forming a dome switch.

22. A method for operating a dome switch, said method comprising:

receiving a user press of a user input assembly including a dome and an actuator feature; and depressing the dome via the actuator feature in response to the user press so as to make an electrical connection to induce a switching actions wherein the dome and the actuator of the user input assembly have a one-piece construction.

* * * * *

UNITED STATES PATENT AND TRADEMARK OFFICE

CERTIFICATE OF CORRECTION

PATENT NO. : 7,687,734 B2
APPLICATION NO. : 12/142333
DATED : March 30, 2010
INVENTOR(S) : Douglas Weber It is certified that error appears in the above-identified patent and that said Letters Patent is hereby corrected as shown below:

In column 8, line 48, in Claim 22, delete "actions" and insert -- action, --, therefor.

Signed and Sealed this
First Day of November, 2011

David J. Kappos
*Director of the United States Patent and Trademark Office*